US011600249B2

(12) United States Patent
Ko

(10) Patent No.: US 11,600,249 B2
(45) Date of Patent: Mar. 7, 2023

(54) SAXOPHONE CLEANING TOOL

(71) Applicant: CHYAU-KE CO., LTD, Caotun Township (TW)

(72) Inventor: Chi-Yi Ko, Caotun Township (TW)

(73) Assignee: CHYAU-KE CO., LTD, Caotun Township (TW)

( * ) Notice: Subject to any disclaimer, the term of this patent is extended or adjusted under 35 U.S.C. 154(b) by 0 days.

(21) Appl. No.: 17/570,516

(22) Filed: Jan. 7, 2022

(65) Prior Publication Data

US 2022/0246118 A1 Aug. 4, 2022

(30) Foreign Application Priority Data

Jan. 29, 2021 (TW) ..... 110201116
Dec. 10, 2021 (TW) ..... 110214735

(51) Int. Cl.
*G10D 9/00* (2020.01)
*G10G 7/00* (2006.01)
*B08B 9/043* (2006.01)

(52) U.S. Cl.
CPC ..... *G10D 9/00* (2013.01); *B08B 9/0436* (2013.01); *G10G 7/00* (2013.01); *B08B 2209/04* (2013.01)

(58) Field of Classification Search
CPC ..... G10D 9/00; G10D 7/08; B08B 9/0436; B08B 2209/04; G10G 7/00
See application file for complete search history.

(56) References Cited

FOREIGN PATENT DOCUMENTS

GB 2482327 A * 2/2012 ..... G10C 3/00

* cited by examiner

*Primary Examiner* — Kimberly R Lockett
(74) *Attorney, Agent, or Firm* — Karin L. Williams; Mayer & Williams PC

(57) ABSTRACT

A saxophone cleaning tool is revealed. The saxophone cleaning tool includes a cleaner provided with a cleaning surface for cleaning an inner surface of a tube, a first pull body having one end connected with a first connection portion of the cleaner and the other end placed into the tube through a tube opening and descending into a curved portion, and a second pull body having one end connected with a second connection portion of the cleaner and the other end placed into the tube through a bell opening and descending into the curved portion. A free end of both the first and second pull bodies is provided with an assembly portion and a magnetic member. Thereby the cleaning tool is passed through the tube easily with the two free ends connected to form a loop which is pulled continuously for fast and cyclic cleaning of the saxophone.

14 Claims, 8 Drawing Sheets

SAXOPHONE CLEANING TOOL

BACKGROUND OF THE INVENTION

Field of the Invention

The present invention relates to a cleaning tool for wind instruments, especially to a saxophone cleaning tool.

Description of Related Art

The saxophone is a type of woodwind instrument. Keep the instrument in optimal operating condition with regular maintenance and care. After each use, moisture can buildup in the body. Without proper cleaning and drying, lots of problems arise. For example, bacteria/bacterium grown in the moisture may cause health-problems for saxophone players, and even generate terrible smell/order after a period of time. The moisture also causes damages to the instrument, especially leather pads which are easy to swell and deform after long-term contact with the moisture. And this not only lead to poor fit of the keys but also influence the sound quality.

Swabs available on the market are broadly used to clean the interior of a main body of saxophones. The swab generally includes a piece of cloth and textile fabric such as absorbent cotton fabric with soft texture in a diamond shape or other shapes, a pull end (or portion) with a smaller width, and a string with a weighted end which is formed by a heavy object such as a metal part mounted therein. The width of the swab is partially increased from the pull end toward the other end thereof.

In order to clean the saxophone by using the swab, first remove the mouthpiece and the neck from the instrument. Insert the string into the saxophone through the bell and the string is descending naturally to reach the bow due to the weighted end. Then make the saxophone upside down so that the string is passed through an opening at the other end of the main body connected with the neck. Next pull out the string to make the swab pass through the tube and clean an inner surface of the tube. Repeat the above process several times to remove moisture and dirt in the tube.

However, in order to pass the string of the swab through the bell and get the string out from the tube opening at the other end of the main body, users need to turn the saxophone upside down. During each passing of the string through the main body for cleaning, the saxophone is placed upside down once. The user usually need to hold the instrument with one hand and operate the swab for cleaning with the other hand while doing an upside down operation. The instrument has larger volume and certain weight so that the upside down operation gives pressure and causes problems to users, even veterans. The instrument is easily damaged once not being held firmly or sliding down. Thereby the upside down operation is not user-friendly and the cleaning process is not efficient.

Moreover, the most common types of saxophones include alto and tenor saxophones with a bit different tube diameters. Based on requirements for manufacturing the instrument itself and components that produces sounds, a tone hole column 2*c* with different heights is formed on an inner surface 2*b* of a tube 2 close to a tube opening 2*a* for connection with a neck, as shown in FIG. 1 and FIG. 2. According to the height, the tone hole column 2*c* is divided into three groups, tone hole column with a lower height, tone hole column having an intermediate height, and tone hole column with a higher height. No matter what kind of the above commercial swabs or other cleaning tools is used, the tone hole columns 2*c* form obstructions during the cleaning process. Thus the operation is not smooth and the cleaning is affected. The swab available on the market may be unable to operate smoothly while being used to clean the saxophones with smaller tube diameters or tone hole column 2*c* having higher heights. Although the operation of the swab becomes smoother when the tone hole column 2*c* is having lower heights or the saxophones have larger tube diameters, the cleaning tool is not in tight contact with the inner surface 2*b* of the tube 2 so that the cleaning effect is affected and the operation is run a few more times.

Thus the saxophones with different tube diameters and tone hole column 2*c* having different heights should be taken into consideration in the design of the cleaning tool. There is room for improvement and there is a need to provide a cleaning tool which is operated smoothly during cleaning of different types of saxophones having tubes with different diameters and tone hole column with different heights such as alto saxophones and tenor saxophones.

SUMMARY OF THE INVENTION

Therefore, it is a primary object of the present invention to provide a saxophone cleaning tool which includes a cleaner, a first pull body, and a second pull body. The cleaner is provided with a cleaning surface used for cleaning an inner surface of a tube of the saxophone. One end of the first pull body is connected with a first connection portion of the cleaner while the other end thereof is placed into the tube through a tube opening of the tube and then descending naturally to a curved portion of the tube. One end of the second pull body is connected with a second connection portion of the cleaner while the other end thereof is placed into the tube through a bell opening of the tube and then descending naturally to the curved portion. A free end of both the first and the second pull bodies is provided with an assembly portion and a magnetic member so that the assembly portions are connected with each other by the magnetic members magnetically attached to each other.

Thereby users can effortlessly pass the cleaning tool through the tube of the saxophone to form a loop by connection of the two free ends of the cleaning tool, without turning the saxophone upside down. Repeated and cyclic cleaning is provided fast by users who pull the loop upward obliquely easily. Not only the operation of the cleaning tool is easy and labor-saving, the cleaning process is also fast and safe. The user-friendly design suits users' needs.

Moreover, users can determine whether the cleaner is added with at least one supplementary cleaning member, or selectively connect the cleaner with one of the supplementary cleaning members for cleaning the saxophone in a continuous and cyclic manner. Therefore, the applicability of the cleaning tool is improved and the cleaning tool is broadly applied to cleaning of alto and tenor saxophones having tone hole columns with different heights under the premise of ensuring the cleaning performance.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
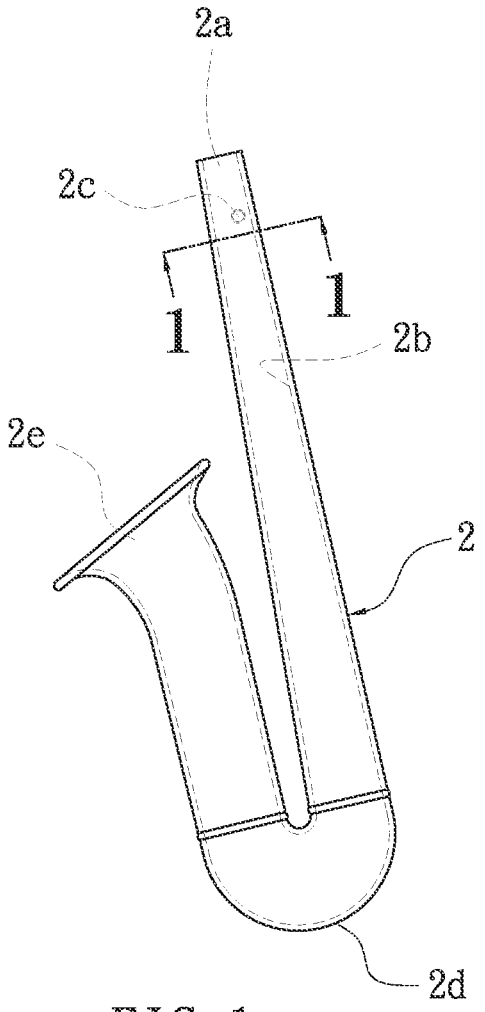
FIG. 1 is a schematic drawing showing a side view of a tube body of a saxophone according to the present invention.
Figure 2:
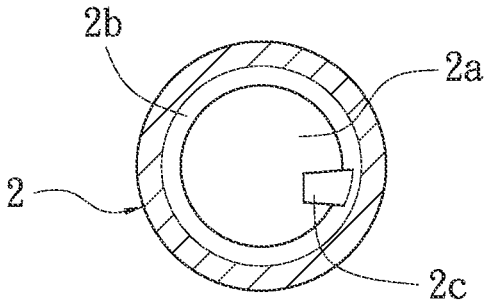
FIG. 2 is a sectional view along line 1-1 in FIG. 1 according to the present invention.
Figure 3:
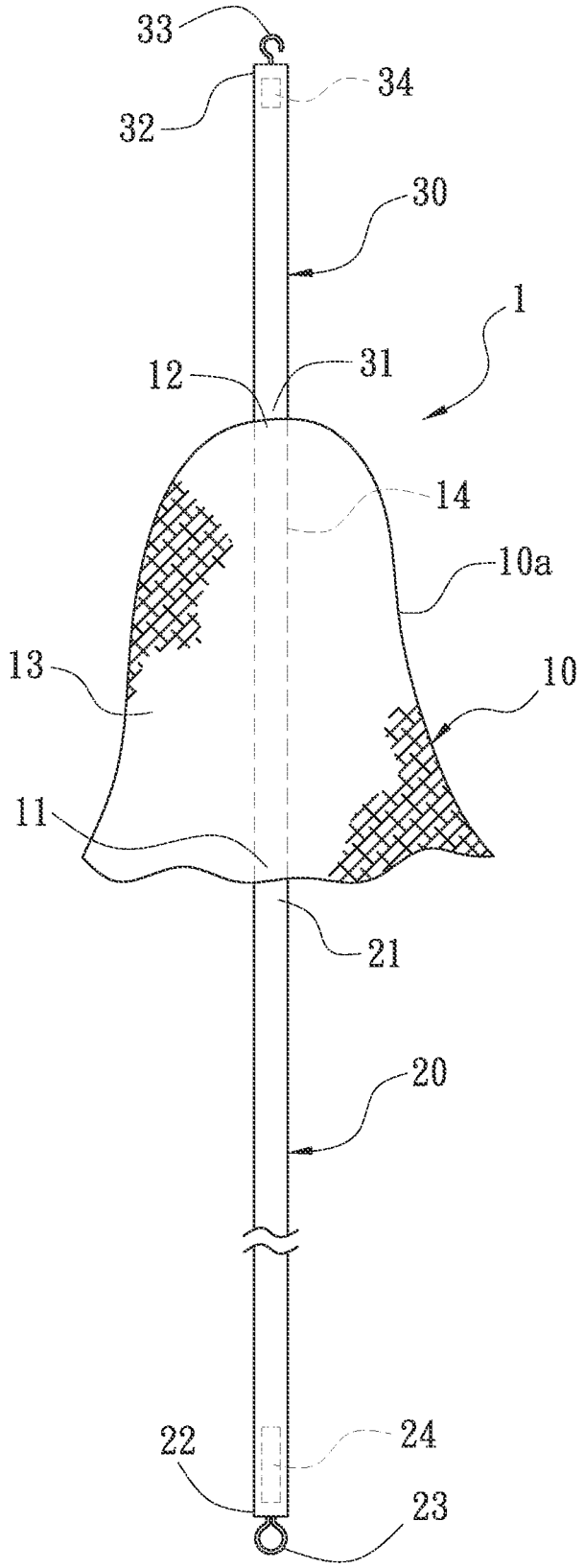
FIG. 3 is a perspective view of an embodiment of a cleaning tool according to the present invention.

As shown in FIG. 1, FIG. 2, and FIG. 3, a saxophone cleaning tool 1 according to the present invention is used to clean an inner surface 2*b* of a tube 2 of a saxophone. Before cleaning, a mouthpiece and a neck of the saxophone need to be removed first.

Refer to FIG. 3, the cleaning tool 1 suitable for saxophones mainly includes a cleaner 10, a first pull body 20 and a second pull body 30.

The cleaner 10 consists of a first connection portion 11, a second connection portion 12, and at least one cleaning surface 13 which is formed between the first connection portion 11 and the second connection portion 12 and used for cleaning an inner surface 2*b* of a tube 2 of the saxophone. In a preferred embodiment, the cleaning surface 13 is formed on both an inner surface and an outer surface of the cleaner 10.

Figure 4:
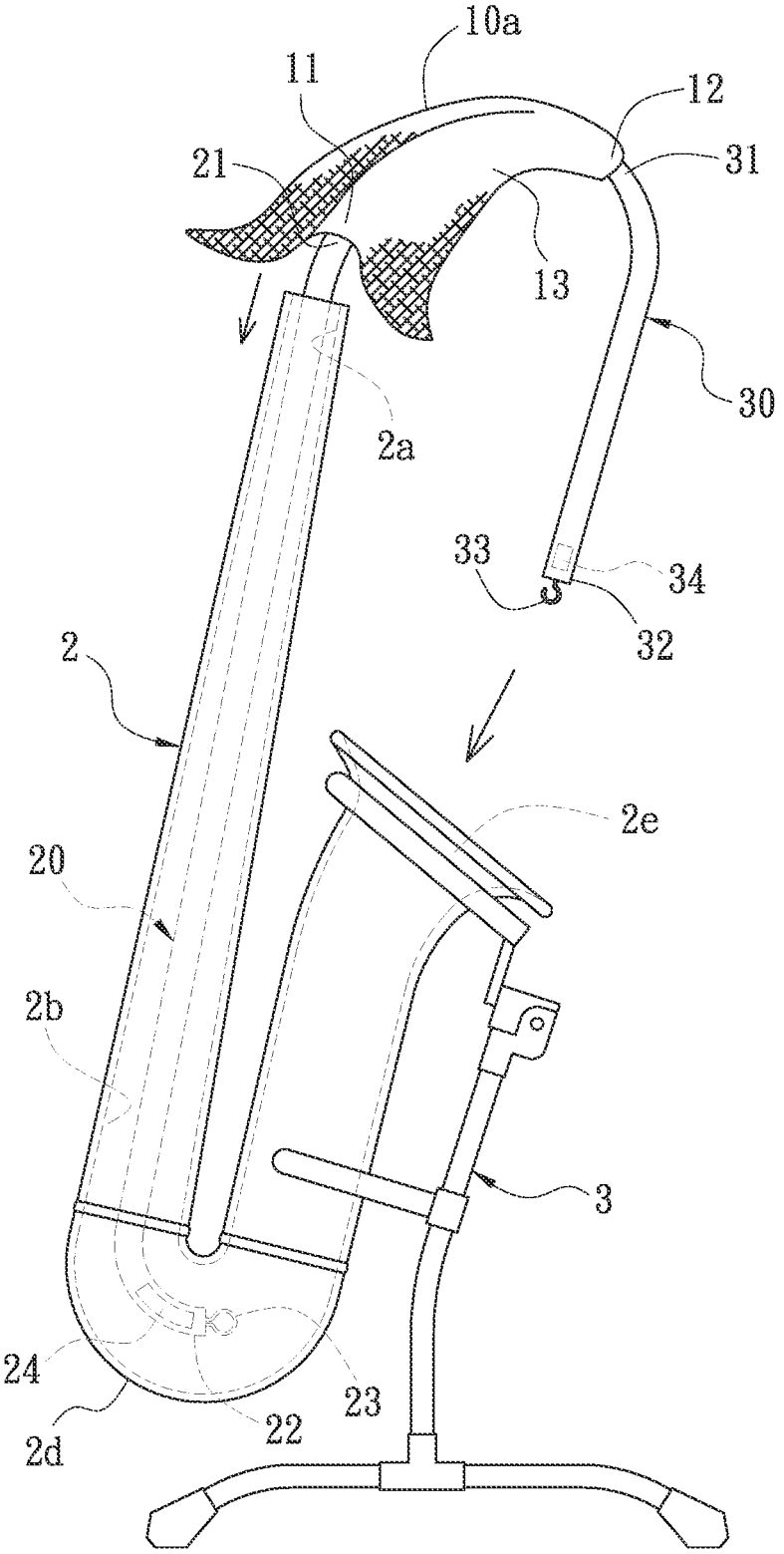
FIG. 4 is a schematic drawing showing movement of an embodiment of a cleaning tool during operation and cleaning according to the present invention.

The first pull body 20 is composed of a first connection end 21, a first free end 22, a first assembly portion 23, and a first magnetic member 24. The first connection end 21 is connected with the first connection portion 11 of the cleaner 10 while the first free end 22 is placed into the tube 2 through a tube opening 2*a* of the tube 2 and then is allowed to descend naturally, as shown in FIG. 4. A length of the first pull body 20 is long enough for the first free end 22 to reach a curved portion 2*d* of the tube 2. Both the first assembly portion 23 and the first magnetic member 24 are arranged at the first free end 22.

The second pull body 30 includes a second connection end 31, a second free end 32, a second assembly portion 33, and a second magnetic member 34. The second connection end 31 is used for connection with the second connection portion 12 of the cleaner 10 while the second free end 32 is placed into the tube 2 through a bell opening 2*e* and then is allowed to descend naturally. A length of the second pull body 30 is long enough for the first free end 22 to reach the curved portion 2*d* of the tube 2. Both the second assembly portion 33 and the second magnetic member 34 are disposed on the first free end 22. The second assembly portion 33 is detachably connected with the first assembly portion 23 of the first pull body 20 while the second magnetic member 34 is magnetically attached to the first magnetic member 24 before the first assembly portion 23 and the second assembly portion 33 connected to each other.

The first assembly portion 23 can be one of a ring and a hook while the second assembly portion 33 is the other one, the hook or the ring. As shown in FIG. 3, the first assembly portion 23 is the ring and the second assembly portion 33 is the hook. Thereby the ring-shaped first assembly portion 23 and the hook-shaped second assembly portion 33 are detachably locked and connected with each other. The first assembly portion 23 and the second assembly portion 33 can also be in other forms of detachable fasteners such as hooks and loops of touch fasteners (Velcro), a button and a loop (or a buttonhole), or a pair of interlocking discs of a snap fastener.

In this embodiment, the cleaner 10 includes a cleaning body 10*a* on which the cleaning surface 13 is formed.

A strip-like connecting body 14 is connected with the cleaning body 10*a* and composed of one end thereof which forms the first connection portion 11 and the other end thereof which forms the second connection portion 12. In an embodiment, the connecting body 14 is directly sawn on the cleaning body 10*a* by common sewing processes and approximately extended along a middle portion of the cleaning body 10*a* so that the cleaning body 10*a* can be spread out smoothly.

In this embodiment, the connecting body 14, the first pull body 20 and the second pull body 30 which are connected integrally and having a part of the same long strip as a main part of themselves. The main part of the connecting body 14, the first pull body 20 and the second pull body 30 is not limited to the strip. It can also be in the form of a rope, a string, a cord, etc.

The cleaning body 10*a* can be a piece of absorbent cloth, scrub cloth, or their combinations. As the name suggests, the absorbent cloth is made of water absorbent material such as cotton fabric. As to the scrub cloth, the cleaning surface 13 of the scrub cloth provides better scrubbing and cleaning effect due to material characteristics or special types of weave.

The cleaning body 10*a* is sheet-shaped such as a common piece of cloth with suitable shapes and sizes, which is able to be adjusted according to a thickness of the sheet-shaped cloth. It is easily understood that no matter how the sheet-shaped cloth is squeezed, the cleaning surface 13 of the cleaning body 10*a* is indeed in contact with the inner surface 2*b* of the tube 2 for cleaning when the cleaning surface 13 is formed on each of two surfaces of the cleaning body 10*a* of the piece of cloth.

One of the first magnetic member 24 and the second magnetic member 34 is a metal part, and the other one is a magnet. In order to ensure that the first free end 22 is allowed to descend and reach the curved portion 2*d* of the tube 2 faster and smoother, the first magnetic member 24 is designed into a metal part with a certain weight. Thus the first magnetic member 24 not only provides magnetic adhesion but also works as a heavy object which helps the descending of the first free end 22. There is no need to arranged a weighted object additionally. As to the second magnetic member 34, it can be designed into a magnet which is having a smaller volume but with a sufficient magnetic adhesion force.

In this embodiment, the cleaning tool 1 can be operated for cleaning while the tube 2 is placed and fixed. For example, the tube 2 is held and positioned on a common saxophone stand or a fixing frame 3, as shown in FIG. 4. Then the first free end 22 of the first pull body 20 is inserted into the tube 2 through the tube opening 2*a*. By the first pull body 20 itself and a weight of the first magnetic member 24 which is the metal part at the first free end 22, the first end 22 is allowed to descend naturally and reach the curved portion 2*d*.

Next the second free end 32 of the second pull body 30 is mounted into the tube 2 through the bell opening 2*e* and then is allowed to descend naturally. Similarly, the second end 32 is allowed to descend naturally and reach the curved portion 2*d* to get closer and contact with the first free end 22 by the second pull body 30 itself and a weight of the second magnetic member 34 which is the magnet at the second free end 32. Thus the first free end 22 and the second end 32 are connected to each other in certain degrees due to magnetic adhesion between the first magnetic member 24 and the second magnetic member 34. Now users only need to pull the second pull body 30 upward and the second free end 32 together with the first free end 22 connected is easily brought out through the bell opening 2*e*.

Figure 5:
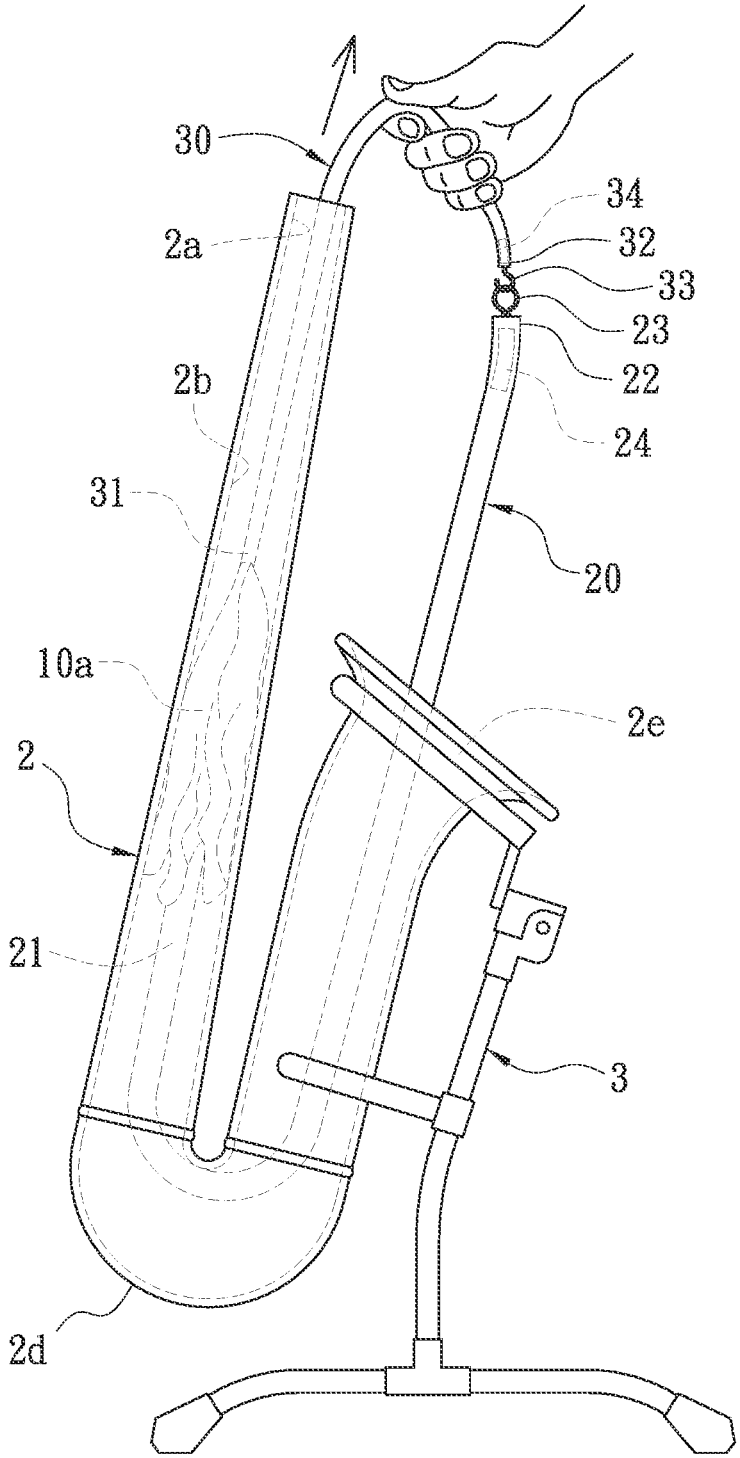
FIG. 5 is a schematic drawing showing an embodiment of a cleaning tool in a form of a loop being operated for cyclic cleaning according to the present invention.

Later the magnetically attached first magnetic member 24 and the second magnetic member 34 are separated from each other. Instead of the magnetic adhesion, now the ring-shaped first assembly portion 23 and the hook-shaped second assembly portion 33 are locked and connected with each other so that the cleaning tool 1 is connected firmly to form a loop. Thereby the user can hold the tube 2 easily with one hand and pull the cleaning tool 1 upward obliquely at the tube opening 2*a* continuously with the other hand. Or the cleaning tool 1 is moved upward and pulled out of the tube opening 2*a* hand over hand. As shown in FIG. 5, each time the cleaning body 10*a* is brought out of the tube opening 2*a*, it is immediately pulled into the tube 2 again through the bell opening 2*e*. Thereby the inner surface 2*b* of the tube 2 is cleaned continuously and repeatedly. It is easily understood that in such continuous and cyclic manner, the tube 2 is cleaned repeatedly within a quite short period of time to achieve easy, fast and efficient cleaning It should be noted that the cleaning process mentioned above is not limited to the condition that the tube 2 is held and positioned at the saxophone stand or the fixing frame 3. The user can operate the cleaning tool 1 by using a single hand or both hands after the tube 2 being fixed by a saxophone strap. Or the tube 2 is held and fixed between two legs for cleaning while the user is seated.

Figure 6:
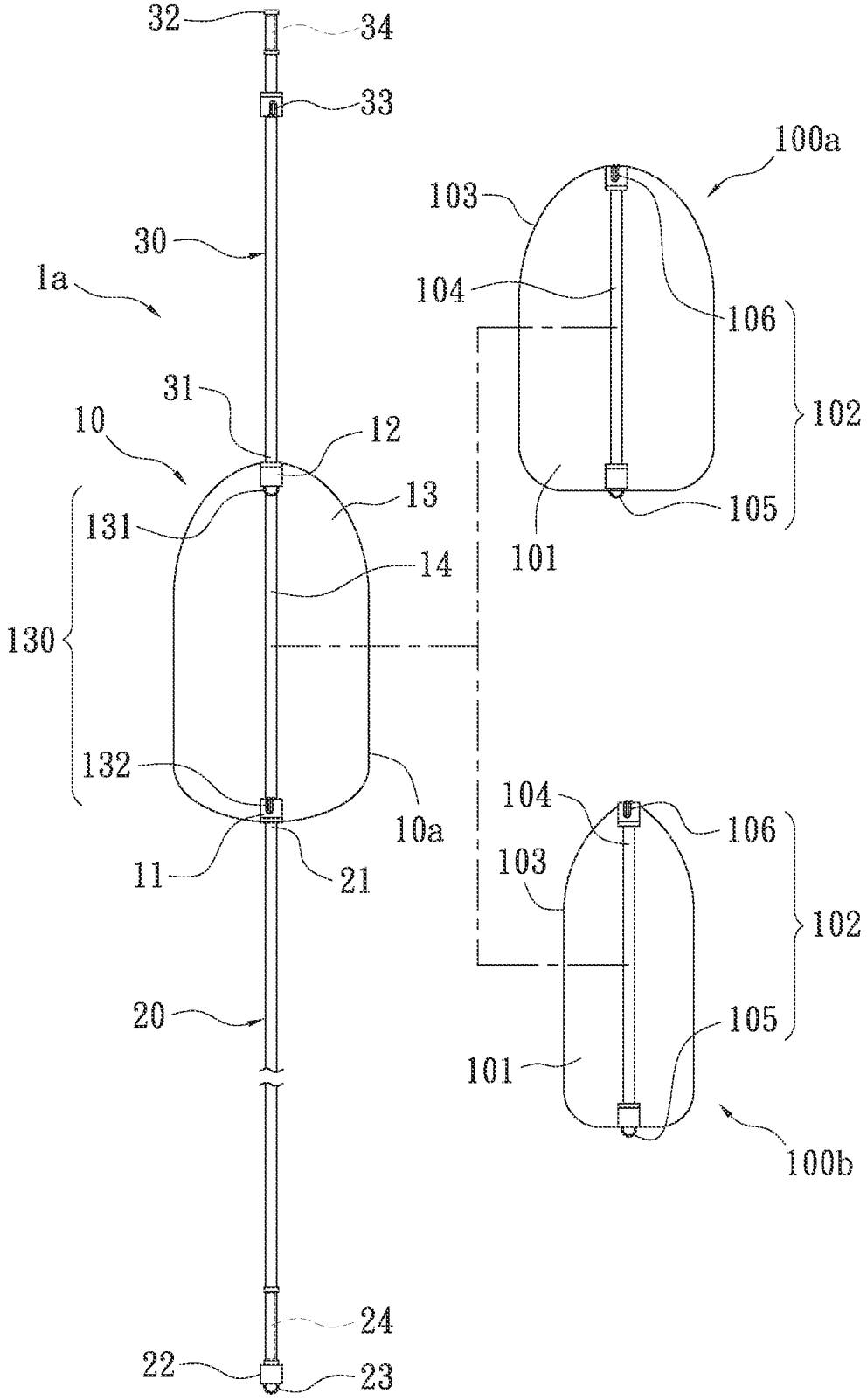
FIG. 6 is a perspective view of another embodiment of a cleaning tool being detached according to the present invention.

Refer to FIG. 6, another embodiment is revealed. A saxophone cleaning tool 1*a* of this embodiment is similar to the cleaning tool 1 of the above embodiment. The two embodiments are only different in that the cleaning tool 1*a* of this embodiment further includes a supplementary cleaning member 100*a* or 100*b* and the cleaner 10 is provided with an auxiliary connection member 130.

Figure 7:
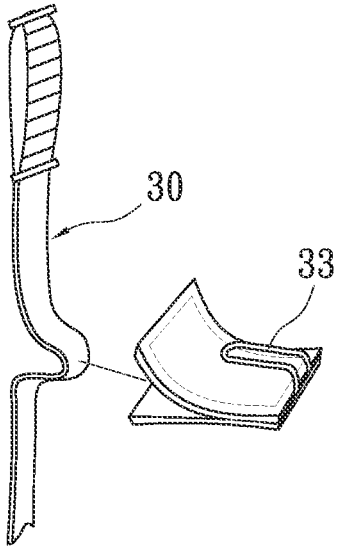
FIG. 7 is a partial exploded view showing a part of a second pull body and a second assembly portion of another embodiment according to the present invention.
Figure 8:
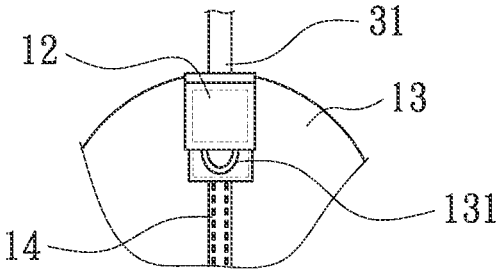
FIG. 8 is a partial perspective view of a cleaner with an auxiliary ring of another embodiment according to the present invention.

Moreover, the supplementary cleaning member 100*a* or 100*b* is provided with at least one cleaning plane 101 for cleaning the inner surface 2*b* of the tube 2 and a supplementary connection member 102 which is detachably connected with the auxiliary connection member 130, as shown in FIG. 6, FIG. 7, and FIG. 8. In this embodiment, two supplementary cleaning members 100*a*, 100*b* with different sizes are provided so that users can select one of the supplementary cleaning members 100*a*, 100*b* suitable for their needs and dispose the cleaning member selected 100*a* or 100*b* on the cleaner 10.

Furthermore, in the embodiment shown in FIG. 6 and FIG. 7, the second assembly portion 33 is disposed on an inner side of the second magnetic member 34. The design is to ensure that the second magnetic member 34 is located at the outermost position and able to be magnetically attached to the first magnetic member 24 more smoothly and efficiently during the operation.

Figure 9:
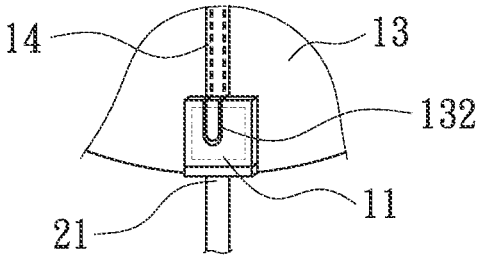
FIG. 9 is a partial perspective view of a cleaner with an auxiliary hook of another embodiment according to the present invention.
Figure 10:
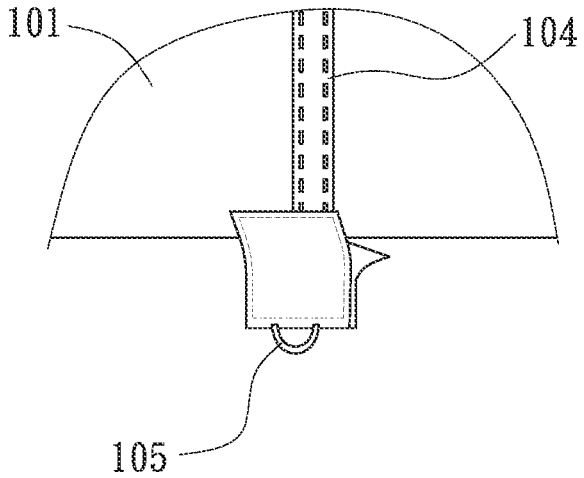
FIG. 10 is a schematic drawing showing a supplementary ring of a first supplementary cleaning member fixed on a connecting portion of another embodiment according to the present invention.
Figure 11:
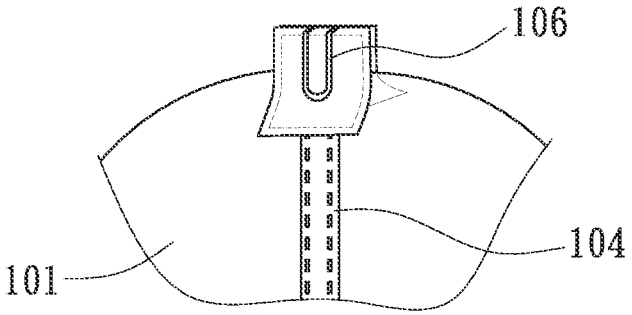
FIG. 11 is a schematic drawing showing a supplementary hook of a first supplementary cleaning member fixed on a connecting portion of another embodiment according to the present invention.

As shown in FIG. 6, FIG. 8, and FIG. 9, the auxiliary connection member 130 of the cleaner 10 consists of an auxiliary ring 131 and an auxiliary hook 132 disposed on two ends of the connecting body 14 correspondingly such as located at or close to the first connection portion 11 and the second connection portion 12. The supplementary cleaning member 100*a* or 100*b* further includes a cleaning portion 103 and a strip-like connecting portion 104 connected with the cleaning portion 103. The supplementary connection member 102 is provided with a supplementary ring 105 and a supplementary hook 106 arranged at two ends of the connecting portion 104 correspondingly. As shown in FIG. 6, FIG. 10, and FIG. 11, the supplementary cleaning member 100*a* or 100*b* is assembled with the cleaner 10 by the supplementary ring 105 detachably connected with the auxiliary hook 132 and the supplementary hook 106 detachably connected with the auxiliary ring 131.

The auxiliary connection member 130 of the cleaner 10 and the supplementary connection member 102 of the supplementary cleaning member 100*a* or 100*b* are not limited to the above hooks and rings mentioned above. They can also be in other forms of the detachable fasteners such as hooks and loops of touch fasteners (Velcro), a button and a loop (or a buttonhole), or a pair of interlocking discs of a snap fastener.

It should be noted that the cleaner 10 in this embodiment is, but not limited to a single cleaning body 10*a*. Users can determine whether the cleaning body 10*a* is used alone or in combination with at least one of the supplementary cleaning members 100*a* 100*b* according to their needs. For example, the cleaner 10 of the cleaning tool 1*a* itself alone is suitable for cleaning the tube 2 of an alto saxophone in which the tone hole column 2*c* on the inner surface 2*b* is having a higher height by the design of the cleaning body 10*a* with suitable shape, size and thickness.

Moreover, the supplementary cleaning members 100*a*, 100*b* having suitable shape, size, and thickness in combination with the cleaner 10 can be applied to cleaning of different types of saxophones. For example, there are two supplementary cleaning members 100*a*, 100*b* with different sizes in this embodiment. A width between two sides of the supplementary cleaning member 100*b* is smaller than that of the supplementary cleaning member 100*a*. When users choose to add the supplementary cleaning member 100*a* on the cleaner 10, an assembly of the cleaner 10 with the supplementary cleaning member 100*a* can be used for cleaning the tube 2 of an alto saxophone in which the tone hole column 2*c* on the inner surface 2*b* is having a lower height, and the tube 2 of a tenor saxophone with the tone hole column 2*c* having a lower height or an intermediate height.

When users choose to dispose the supplementary cleaning member 100*b* on the cleaner 10, the assembly of the of the cleaner 10 with the supplementary cleaning member 100*b* can be applied to clean the tube 2 of an alto saxophone in which the tone hole column 2*c* on the inner surface 2*b* is having an intermediate height, and the tube 2 of a tenor saxophone in which the tone hole column 2*c* on the inner surface 2*b* is having a higher height.

The tube 2 of the alto saxophone is having a bit smaller bore diameter than the tube 2 of the tenor saxophone and a space in the alto saxophone which allows the cleaner 10 to pass through is smaller when the tone hole column 2*c* is having a higher height. Thus there is no need to add the supplementary cleaning member 100*a* or 100*b* on the cleaning tool 1*a* while being used for cleaning the alto saxophone with the tone hole column 2*c* having a higher height. Likewise, either the supplementary cleaning member 100*a* or the supplementary cleaning member 100*b* can be selected and attached to the cleaning tool 1*a* for cleaning the tenor saxophone in which the tone hole column 2*c* on the inner surface 2*b* is having a lower height. Thereby the cleaning tool 1*a* can be used to clean both the alto saxophone and the tenor saxophone having the tone hole column 2*c* with different heights.

The operation of the cleaning tool 1*a* in this embodiment is about the same as that of the cleaning tool 1 of the above embodiment.

Figure 12:
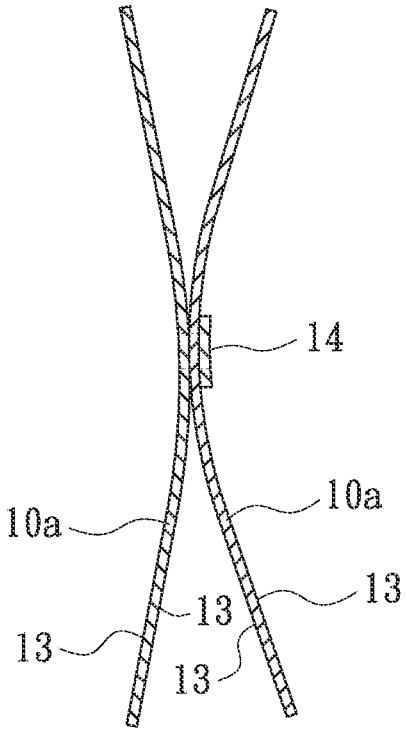
FIG. 12 is a schematic drawing showing a cross section of another embodiment provided with two cleaning bodies of another embodiment according to the present invention.

The cleaner 10 is not limited to the single cleaning body 10*a* mentioned above. It can also include at least two cleaning bodies 10*a*. For example, the cleaner 10 includes two cleaning bodies 10*a*, as shown in FIG. 12. The two cleaning bodies 10*a* are connected with the same strip-like connecting body 14 by sewing along a middle portion or in other ways. Thus more cleaning surfaces 13 are formed within the cleaning bodies 10*a* of this embodiment compared with the embodiment with the single cleaning body 10*a*. During the cleaning process, better water absorption and cleaning effect is achieved through contact between different cleaning surface 13 and the inner surface 2*b* of the tube 2. Yet the number of the cleaning bodies 10*a* used can be changed according to objective factors of the cleaning bod 10*a* itself such as material characteristics, shape, size and thickness.

In summary, the cleaning tool 1, 1*a* for saxophones according to the present invention has the following features and effects.

1. Effective and efficient: the cleaning tool 1, 1*a* is inserted through the tube 2 with the two ends connected to form a loop. The design ensures that users can pull the loop continuously and easily for cyclic cleaning process of the saxophone. Thereby high quality cleaning is completed smoothly within a quite short period of time. Both cleaning effect and efficiency are significantly improved.
2. User-friendly operation and high safety: the cyclic cleaning process is performed easily by using the present device when the tube 2 is held and positioned and there is no need to hang and turn the saxophone upside down. Thus the operation of the cleaning tool 1, 1*a* is easy and safe.
3. Easy and fast formation of a loop connected firmly. The first free end 22 of the first pull body 20 and the second free end 32 of the second pull body 32 are aligned and connected with each other by magnetic adhesion, without turning the tube 2 upside down. In combination with the design of the assembly portions connected with each other, a firm loop for continuous and cyclic cleaning is formed easily and quickly.
4. Broad applications to alto and tenor saxophones with the tone hole column 2*c* having different heights. According to the type of the saxophone (alto or tenor) and the height of the tone hole column 2*c*, users can determine whether the supplementary cleaning member 100*a*, or 100*b* is added or select the suitable supplementary cleaning member 100*a*, or 100*b* to carry out the cleaning in a continuous and cyclic manner Thereby the applicability of the cleaning tool 1*a* is improved and the cleaning tool 1*a* is able to be widely applied to the cleaning of the alto and tenor saxophones with the tone-hole cylinder having different heights under the premise of ensuring the cleaning performance. Therefore, problems of the conventional swab such as unsmooth operation and poor cleaning effect caused by different types of saxophones can be solved.
5. Flexible adjustment and various combinations: the number of the cleaning bodies 10*a* used can be determined according to objective factors of the cleaning body 10*a* itself such as material characteristics, shape, size and thickness so as to achieve better water absorption and cleaning effect.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A cleaning tool for saxophones each of which includes a detachable neck and a removable tube having a tube opening located at one end thereof and connected with the neck, a bell opening located at the other end thereof, and a curved portion, comprising:

a cleaner which includes a first connection portion, a second connection portion, and at least one cleaning surface which is formed between the first connection portion and the second connection portion for cleaning an inner surface of the tube;

a first pull body which includes a first connection end connected with the first connection portion of the cleaner and a first free end which is placed into the tube through the tube opening to descend naturally and provided with a first assembly portion and a first magnetic member; a length of the first pull body is long enough for the first free end to reach the curved portion of the tube; and a second pull body which includes a second connection end connected with the second connection portion of the cleaner and a second free end which is placed into the tube through the bell opening to descend naturally and provided with a second assembly portion and a second magnetic member; a length of the second pull body is long enough for the second free end to reach the curved portion of the tube; wherein the second assembly portion of the second pull body is detachably connected with the first assembly portion of the first pull body while the first magnetic member and the second magnetic member are magnetically attached to each other before the first assembly portion and the second assembly portion connected with each other.

2. The cleaning tool for saxophones as claimed in claim 1, wherein the cleaner includes at least one cleaning body on which the cleaning surface is formed.

3. The cleaning tool for saxophones as claimed in claim 2, wherein the cleaner includes a cleaning body which is connected with a strip-like connecting body; one end of the connecting body forms the first connection portion and the other end of the connecting body forms the second connection portion.

4. The cleaning tool for saxophones as claimed in claim 3, wherein the connecting body, the first pull body, and the second pull body are connected integrally.

5. The cleaning tool for saxophones as claimed in claim 4, wherein the connecting body, the first pull body, and the second pull body are selected from the group consisting of a rope, a string, a cord, and a strip.

6. The cleaning tool for saxophones as claimed in claim 3, wherein the cleaning body is selected from the group consisting of absorbent cloth, scrub cloth, and a combination thereof.

7. The cleaning tool for saxophones as claimed in claim 3, wherein the cleaning body is sheet-shaped.

8. The cleaning tool for saxophones as claimed in claim 1, wherein one of the first magnetic member and the second magnetic member is a metal part and then the other of the first magnetic member and the second magnetic member is a magnet.

9. The cleaning tool for saxophones as claimed in claim 1, wherein one of the first assembly portion and the second assembly portion is a ring and then the other one of the first assembly portion and the second assembly portion is a hook; the hook and the ring are detachably locked and connected with each other; wherein the second assembly portion is disposed on an inner side of the second magnetic member.

10. The cleaning tool for saxophones as claimed in claim 1, wherein the cleaning tool further includes at least one supplementary cleaning member which is provided with at least one cleaning plane for cleaning the inner surface of the tube and a supplementary connection member; the cleaner is further provided with an auxiliary connection member which is detachably connected with the supplementary connection member.

11. The cleaning tool for saxophones as claimed in claim 10, wherein the cleaner includes at least one cleaning body which is provided with the cleaning surface and connected with a strip-like connecting body; one end of the connecting body forms the first connection portion and the other end of the connecting body forms the second connection portion; wherein the auxiliary connection member includes an auxiliary ring and an auxiliary hook disposed on two ends of the connecting body of the cleaner correspondingly; wherein the supplementary cleaning member is provided with a cleaning portion which is having the cleaning plane and connected with a strip-like connecting portion; wherein the supplementary connection member is provided with a supplementary ring and a supplementary hook arranged at two ends of the connecting portion correspondingly; thereby the supplementary cleaning member is mounted to the cleaner by the supplementary ring detachably connected with the auxiliary hook and the supplementary hook detachably connected with the auxiliary ring.

12. The cleaning tool for saxophones as claimed in claim 11, wherein the cleaner includes two cleaning bodies which are both connected with the strip-like connecting body.

13. The cleaning tool for saxophones as claimed in claim 10, wherein the cleaning tool includes two supplementary cleaning members; a width between two sides of one of the supplementary cleaning members is smaller than a width between two sides of the other supplementary cleaning member; one of the supplementary cleaning members is selectively connected to the cleaner by the supplementary connection member thereof connected with the auxiliary connection member of the cleaner.

14. The cleaning tool for saxophones as claimed in claim 11, wherein both the connecting body and the connecting portion are selected from the group consisting of a rope, a string, a cord, and a strip; both the cleaning body and the cleaning portion are sheet-shaped and selected from the group consisting of absorbent cloth, scrub cloth, and a combination thereof.

* * * * *